United States Patent [19]

Holmes et al.

[11] 4,153,248

[45] May 8, 1979

[54] BALL

[76] Inventors: Dale E. Holmes, 329 E. Prospect, Marshall, Mich. 49068; Donald W. Konkle, 4243 18-1/2 Mile Rd., Tekonsha, Mich. 49092; C. James Warner, 128 Winter, Battle Creek, Mich. 49016; Richard L. Hansen, 90 College St., Battle Creek, Mich. 49017

[21] Appl. No.: 861,364

[22] Filed: Dec. 16, 1977

[51] Int. Cl.[2] ..... A63B 37/00

[52] U.S. Cl. ..... 273/58 A; 273/58 K; 272/68

[58] Field of Search ..... 273/58 K, 58 F, 58 D, 273/58 E, 183 C, 106 R; 46/26, 23; 45/155; 272/68, 122, 123, 96

[56] References Cited

U.S. PATENT DOCUMENTS

| | | | |
|---|---|---|---|
| 784,367 | 3/1905 | Williams | 272/68 |
| 1,412,691 | 4/1922 | Lincoln | 272/68 |
| 1,549,710 | 8/1925 | Campbell | 272/68 |
| 2,142,305 | 1/1939 | Davis | 46/26 UX |
| 2,351,762 | 6/1944 | Hoover | 273/58 F |
| 2,571,275 | 10/1951 | Meaker | 46/155 X |
| 3,822,499 | 7/1974 | De Vos | 273/58 K X |
| 4,040,619 | 8/1977 | Landi | 272/68 |

FOREIGN PATENT DOCUMENTS

| | | | |
|---|---|---|---|
| 24541 | 4/1922 | United Kingdom | 46/26 |

*Primary Examiner*—George J. Marlo
*Attorney, Agent, or Firm*—Blanchard, Flynn, Thiel, Boutell & Tanis

[57] ABSTRACT

A monolithic ball structure made of resilient material and consisting of two equal diameter spherical sections connected by a neck portion of reduced diameter. The neck portion is defined by a segment of a surface generated by the revolution of a planar arc about an axis lying in its plane. The axis in this particular structure coincides with the common axis connecting the center points of the two aforementioned spheres. The radius of the arc is one-eighth of the diameter of the sphere in one particular embodiment thereof. The resilient material has a Durometer hardness value in the range of 40 shore A to 60 shore A.

3 Claims, 3 Drawing Figures

BALL

FIELD OF THE INVENTION

This invention relates to a resilient ball construction and, more particularly, relates to a resilient monolithic ball construction consisting of two spherical portions interconnected by a neck portion of reduced diameter.

BACKGROUND OF THE INVENTION

There are many toys on the market at the present time which require a degree of skill in exercising the proper control thereof. It is the inventors' desire, with the present invention, to provide a ball construction which will require a certain degree of skill in order to effect a meaningful use and control thereof. It is a further desire and purpose of the invention to enable the user, after a period of practice therewith, to overcome the uncertainties in the control thereof so that the toy ball will perform in the desired manner controlled by the user thereof.

SUMMARY OF THE INVENTION

In general, the objects and purposes of the invention are met by providing a ball construction made of a resilient material and consisting of two spherical segments interconnected by a neck portion of reduced diameter. The reduced neck portion is defined by a continuous arcuate or partial toroidal surface generated by the revolution of an outwardly opening planar arc about an axis lying in its plane. In a specific embodiment of the invention, the radius of the arc is equal to one-eighth of the diameter of a spherical portion. In addition, the axis about which the open planar arc is rotated coincides with the common axis joining the center point of the two aforementioned spheres.

BRIEF DESCRIPTION OF THE DRAWING

Further objects and purposes of this invention will be apparent to persons acquainted with apparatus of this general type upon reading the following specification and inspecting the accompanying drawing, in which.

DETAILED DESCRIPTION

The ball construction 10 consists of two spherical ball segments 11 and 12 interconnected by a neck portion 13 of reduced diameter. The ball is of a monolithic construction and made of a resilient material having a Durometer hardness value in the range of 40 Shore A to 60 Shore A. In the preferred embodiment, the Durometer hardness value is 50 Shore A. The specific material of the ball is the same throughout the ball construction and is readily available under compound No. M8500-50, readily available from Jackson Flexible Products, 7765 Clinton Road, Jackson, Michigan 49201.

Figure 1:
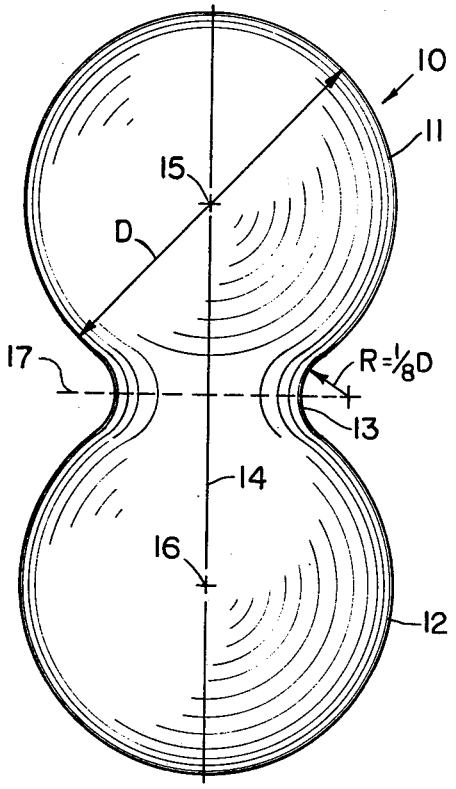
FIG. 1 is a side elevational view of the ball construction embodying the invention.
Figure 2:
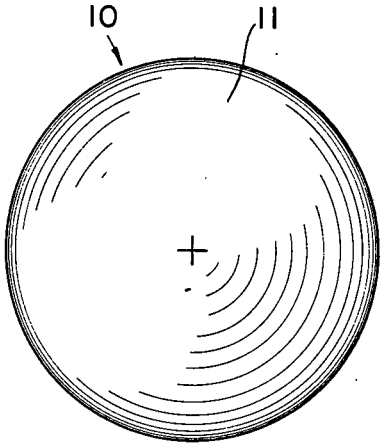
FIG. 2 is a top view thereof.
Figure 3:
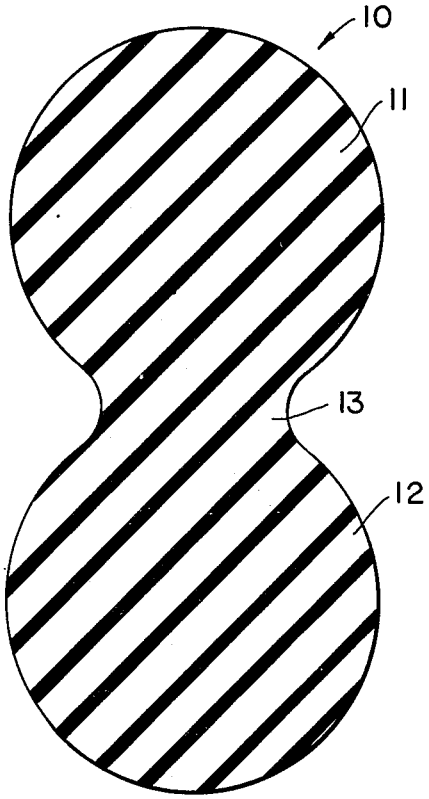
FIG. 3 is a central sectional view.

In a specific embodiment of the invention, the neck portion 13 is comprised of a partial toroidal surface generated by the revolution of a radially outwardly opening planar curve about an axis lying in its plane. In this particular embodiment, the axis is the common axis 14 joining the center points 15 and 16 of the two spherical ball segments illustrated in FIG. 1. The radius R of the radially outwardly opening planar curve is equal to one-eighth of the diameter D of one of the spherical ball segments. The partial toroidal surface 13 is tangent to the surface of both of the two spherical ball segments 11 and 12 as shown in FIG. 1. In addition, the mass of the ball construction on opposite sides of a plane 17 perpendicular to the common axis 14 and equidistant from the center points 15 and 16 are equal.

In use, the toy ball construction is designed to be more challenging to children and adults than an ordinary spherical ball. The molded ball construction disclosed herein will have a very erratic bounce that will challenge all who try to control it. The object of its use, of course, is to throw the ball at a target or a surface and have it return in a preconceived manner. The most common form of this invention will be 1¼ inches in diameter (3.175 cm) by 2½ inches long (6.350 cm). A slightly larger size will be applicable for use as a therapeutic hand muscle strengthener for stroke victims and paralysis victims. The resiliency of the material of the ball construction is a definite advantage for the aforesaid use.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ball construction, comprising:

a pair of spaced spherical ball segments of equal diameter interconnected by a neck portion of reduced diameter to form a monolithic structure, said neck portion being a continuous partial toroidal arcuate surface generated by the revolution of a radially outwardly opening planar curve about an axis lying in its plane, said continuous arcuate surface being tangent to the surfaces of both of said spherical ball segments and having a fixed radius, said ball construction being made of the same resilient material throughout and having a Durometer hardness value in the range of 40 Shore A to 60 Shore A and the masses of said spherical ball segments and said neck portion are equal on opposite sides of a plane containing the revolved center of said planar curve forming said partial toroidal surface.

2. A ball according to claim 1, wherein said planar curve has a radius equal to one-eighth the diameter of one of said spherical ball segments.

3. A ball according to claim 1, wherein said Durometer hardness value is 50 Shore A.

* * * * *